US007077185B2

(12) United States Patent
Steinberger

(10) Patent No.: US 7,077,185 B2
(45) Date of Patent: Jul. 18, 2006

(54) TAPE DISPENSER

(76) Inventor: Robert Steinberger, 14 Van Winkle Rd., Monsey, NY (US) 10952

( * ) Notice: Subject to any disclaimer, the term of this patent is extended or adjusted under 35 U.S.C. 154(b) by 0 days.

(21) Appl. No.: 10/818,213

(22) Filed: Apr. 5, 2004

(65) Prior Publication Data

US 2004/0194895 A1 Oct. 7, 2004

Related U.S. Application Data

(63) Continuation-in-part of application No. 10/408,134, filed on Apr. 7, 2003, now Pat. No. 6,971,431.

(51) Int. Cl.
*B32B 31/00* (2006.01)

(52) U.S. Cl. ..... 156/527; 156/576; 156/577; 156/579; 225/56; 225/80

(58) Field of Classification Search ..... 156/577, 156/574, 579, 523, 522, 527, 576, 530; D19/67, D19/69; 225/23, 56, 77, 89, 91
See application file for complete search history.

(56) References Cited

U.S. PATENT DOCUMENTS

| | | | | |
|---|---|---|---|---|
| 2,823,968 A | | 2/1958 | Marcuse et al. | |
| 3,470,781 A | | 10/1969 | Domeny | |
| 3,895,059 A | | 7/1975 | Link | |
| 3,971,280 A | | 7/1976 | Inka | |
| 4,345,966 A | * | 8/1982 | Iiyama et al. | 156/523 |
| 4,486,263 A | * | 12/1984 | Monzo Gomez | 156/523 |
| 4,640,167 A | | 2/1987 | Stusack et al. | |
| 4,775,084 A | | 10/1988 | Morikami et al. | |
| 5,169,479 A | * | 12/1992 | Hoddinott et al. | 156/355 |
| 5,257,711 A | | 11/1993 | Wirtz-Odenthal | |
| 5,295,753 A | * | 3/1994 | Godo et al. | 400/612 |
| 5,573,616 A | * | 11/1996 | De Roeck | 156/185 |
| 6,053,233 A | | 4/2000 | Lin | |
| 6,510,884 B1 | | 1/2003 | Chan | |
| 2002/0069974 A1 | | 6/2002 | Niermann | |

* cited by examiner

*Primary Examiner*—Mark A. Osele
(74) *Attorney, Agent, or Firm*—Michael E. Zall

(57) ABSTRACT

A hand held tape dispenser for applying adhesive tape to a surface. The dispenser includes a housing for holding and dispensing a roll of tape and has a tape dispensing opening therein. A plurality of rollers are within the housing, the outer surfaces of which coact with each other and the tape to retain, guide and feed the tape through the opening. The outer surface of at least one of the rollers protrudes through the opening on one side thereof enabling frictional contact of the roller with the surface to be taped. When the tape dispenser passes over the surface in one direction the outer surface of the roller engages the surface and the tape causing it to roll and to coact and drive the other rollers. This causes the rollers to grip the surfaces of the tape and feed the tape through the opening enabling the tape to adhesively contact the surface and adhere thereto. The tape is cut off at the opening.

15 Claims, 14 Drawing Sheets

TAPE DISPENSER

RELATED APPLICATIONS

This application is a continuation-in-part application of U.S. Ser. No. 10/408,134 filed on Apr. 7, 2003, now U.S. Pat. No. 6,971,431. The entire disclosure of this application is incorporated herein by reference.

BACKGROUND OF THE INVENTION

1. Field of the Invention

This invention relates to a tape dispenser for applying pressure sensitive tape to a substrate surface. The dispenser is provided with a cutter for the tape and a plurality of rollers that smoothly and evenly feed and apply the tape onto the substrate.

2. Description of the Related Art

A roll of adhesive tape typically is mounted in a dispenser. The tape roll is usually a palm sized roll. Such a dispenser includes at least one side wall aligned substantially perpendicular to the axis of the spool. The side wall includes structure for rotatably maintaining the spool in the dispenser. Such a tape dispenser further includes an exposed metal or plastic serrated cutting blade. The cutting blade is mounted to a portion of the dispenser spaced from the spool and is aligned parallel to the rotational axis of the spool. A portion of the tape is may be supported and releasably retained on the cutting blade of the dispenser.

The tape may be used by grabbing a portion of the tape with a thumb and forefinger at a location between the spool and the cutting blade. The tape is then separated from the cutting blade and pulled relative to the dispenser. The pulling force causes the spool to rotate in the tape dispenser, and permit the tape to be dispensed. After a sufficient length of tape has been pulled from the spool, the user then engages a portion of the tape slightly beyond the cutting blade and urges the tape against the cutting blade with sufficient force to sever the tape at a location adjacent the cutting blade. The severed section of tape then is applied to a substrate as needed. Portions of the tape on the spool side of the cutting blade will remain adhered to the cutting blade for the next dispensing operation.

Generally, the user has to visually assess the length of tape required when severing the tape before applying the tape to a surface such as a package or letter. Such visual assessment is rarely accurate and the tape length severed is either too long or too short. Also, in transporting the length of tape to the point-of-use, the tape may twist or crinkle leading to an untidy package closure or letter seal. Finally, it is necessary as a separate step to press the tape firmly into position against the package or envelope. It is thus very difficult through the use of conventional tape dispensers to get the exact length of adhesive tape that you need applied to the exact location you want. Other problems associated with such prior art dispensers are that the end of the tape always remains in an exposed and the exposed cutting blade can be hazardous, particularly to children Still further, such prior art tape dispensers are not well suited for single-handed use. In particular, a small tape dispenser must be gripped by one hand while the other hand engages the tape and pulls the tape from the blade and beyond the dispenser. The one hand remains on the dispenser and the other hand remains on the tape as the tape is severed. The two-handed dispensing of tape can be carried out fairly easily with a small tape dispenser and for a small piece of tape (e.g., 1–2 inches). In particular, the hand that pulls the tape typically will not have to be repositioned to urge the tape against the blade. The dispensing becomes much more difficult if a longer piece of tape is required. In particular, to dispense a long piece of tape, the tape is first grabbed between the blade and the spool and separated from the blade. The user then pulls a sufficient length of tape from the spool and urges the tape against the blade. The hand that has pulled the tape then must be removed from the free end of the tape to engage the tape at a location closer to the blade. This causes the free end of the tape to move, often in response to electrostatic forces. The free end of the tape often will adhere to itself or to an unintended surface.

The above-described complications can be avoided with a large heavy tape dispenser that has a broad base. This type of prior art tape dispenser can be supported without being gripped manually. Hence, the tape can be pulled from the dispenser with one hand, thereby leaving the other hand free for some other purpose, such as holding the object to be taped. Additionally, two hands can be employed, if necessary, to hold both ends of a long piece of tape. However, such a solution still suffers from the usual disadvantages of such dispensers.

Another disadvantage of these prior art dispensers is that the user must manually grip the adhesive surface of the tape at least once to dispense the tape. This manual gripping reduces the adhesiveness of the tape and may transfer soil from the finger to the adhesive side of the tape. The soil, often in the form of a fingerprint, remains on the tape and may be visible on the object to which the tape is applied.

Still further, it is often desirable to apply the tape directly from the dispenser to the object being taped. The large heavy prior art tape dispenser that is suitable for some single-handed use cannot conveniently be positioned adjacent the object to which the tape is to be applied. The lighter weight disposable tape dispenser can be manipulated fairly easily. However, these dispensers are not well suited to direct application of the tape from the dispenser to the object being taped. In particular, the tape can not be fed smoothly onto the surface and pressed into adhesive contact therewith. At best the application is sporadic and two hands are required, i.e., one to hold the dispenser close to the surface and the other to hold the tape onto the substrate to pull the tape from the roll and press it onto the surface.

The following references describe some of the known prior art dispensers:

U.S. Pat. No. 2,823,968 to Marcuse et al. describes a paper towel dispenser having several feed rollers operatively engaged with each other to permit the hand removal of a predetermined length of toweling.

U.S. Pat. No. 3,470,781 to Domeny describes an attachment to a tape dispenser that has a thumb-operated knurled roller on the attachment for engaging and feeding the tape or optionally to permit the tape to be pulled out of the dispenser independently of the roller.

U.S. Pat. No. 3,895,059 to Link describes a tape dispenser that has a guide passage between the chamber in which a roll of tape is retained and the exterior. Oppositely acting ridges in the guide passage exert a holding effect on the tape to keep a free end available to be engaged by the user. A stationary external cutter is pressed against the tape to cutoff a measured length or to cut the tape adjacent where it adheres to the surface to which it is attached. Other forms of the device employ an internal cutter, one of which is manually pressed into cutting engagement with the tape and another of which is snapped into cutting engagement.

U.S. Pat. No. 3,971,280 to Inka describes a tape container and dispensing apparatus formed of plastic material that has a finger operated knurled knob for advancing the tape to dispense a strip of any desired length and a scissors-like shearing means integrally formed therewith a to cut the tape strip.

U.S. Pat. No. 4,640,167 to Stusack et al. describes a single hand operated device for dispensing a desired length of tape from a supply reel. The tape is rotatably supported in a housing and fed out by means of a hand operated drive wheel. The housing also contains a knife which is manually actuable in the direction of the tape to cut the tape.

U.S. Pat. No. 4,775,084 to Morikami et al. describes an adhesive tape case having a cutter that is fixed adjacent to a tape outlet of the case body. In addition, two rollers driven through two gears are provided for advancing a length of tape to the tape outlet. The gears are driven by the manual operation of an operational knob through a rack plate. The rack plate is adapted to engage with one of the gears when moving forward and to separate therefrom when moving backward.

U.S. Pat. No. 5,257,71 to Wirtz-Odenthal describes an apparatus for dispensing an apportioned length of paper towel from a roll and automatically cutting the length from the roll with a knife.

U.S. Pat. No. 6,053,233 to Lin describes an automatic tape cutter/sticker that includes a bottom shell body, a main shell body pivoted to the bottom shell body and turned in and out of aside opening on the bottom shell body, the main shell body having an annular tube, which holds an adhesive tape, and an arched spring plate, which is mounted in the annular tube and having two opposite ends extended out of respective slots on the annular tube to hold the adhesive tape in place, a rotary cutter holder with a cutter blade rotated by the main shell body to cut the free end of the adhesive tape, a rotary guard plate rotated by the main shell body in the reverse of the rotary cutter holder to close/open a tape outlet notch slot on the bottom shell body, and a cover plate covered on the bottom shell body, the cover plate having coupling means at one end hinged to one side of the bottom shell body, and hook means at an opposite side for hooking in a hook hole at an opposite side of the bottom shell body.

U.S. Pat. No. 6,510,884 to Chan describes an adhesive tape dispenser that has a lower compartment with a bottom aperture and a cutting blade at one side of the aperture. A length of tape is dispensed through the aperture and severed by the blade. During dispensing, a pressure roller, mounted adjacent the aperture, is pressed down to press the tape firmly against an external surface and to space the tape away from the cutting blade during dispensing.

U.S. Pat. No. 2002/0069974 to Niermann describes a tape dispenser that includes a tape roll chamber with a hub having an axis about which a roll of tape rotates. A tape dispensing channel that extends from the tape roll chamber is configured to twist the tape approximately 90 degrees about its longitudinal axis. A window is defined near the end of the tape dispensing channel to enable an index finger to apply pressure to the non-adhesive surface of the tape for urging the adhesive surface of the tape against a substrate. A blade support wall is disposed distally of the window and includes a serrated blade for severing the tape. The lower surface of the blade support wall is arcuately configured for urging the tape into secure adhesion with the substrate.

OBJECTS AND SUMMARY OF INVENTION

It is an object of this invention to provide a tape dispenser which permits the application of an adhesive tape to a surface directly from the dispenser using only one hand to accurately position the tape at the proper location on the substrate and precisely cut the correct length of tape to be used.

It is yet another object of this invention to provide a tape dispenser capable of accurately aligning the tape on the surface to which it is to be applied, simultaneously pressing it into adhesive contact with such surface and then accurately cutting off the precisely desired length.

It is still another object of this invention to provide a tape dispenser wherein the tape is dispensed by the rotation and coaction of the surfaces of a plurality of rollers which are driven by moving the dispenser along the surface to which the tape is to be applied.

Still another object of this invention is to provide a tape dispenser which includes a tape cut-off bar which remains inactive or hidden while the tape is being dispensed and applied but which, by a simple manipulation of the dispenser accurately cuts the tape to the desired length.

An additional object of this invention is to provide a low-cost tape dispenser wherein all parts, both static and moving, are simply constructed and compactly contained.

Also included among the objects of the invention is to provide a tape dispenser wherein the container can be made of inexpensive plastic material.

It is a further object of this invention to provide a tape dispenser that can be used for many type taping operations, such as taping paper together or as packing tape, is easy and intuitive to use and may be used with tape having an adhesive surface on both sides.

It is yet another object of this invention to provide unique a tape dispenser that is similar in appearance to common prior art dispensers but has a unique structure and function.

It is yet a further object of this invention to provide a tape dispenser that is refillable or disposable and may be a desk-top model or portable and may be used solely as a dispenser or as a tape applicator.

It is also an object of this invention to overcome or at least reduce the enumerated problems associated with conventional tape dispensers.

All of the foregoing objects as well as others are achieved by the tape dispenser of this invention. The dispenser is used for applying adhesive tape to a substrate surface, the tape having a first surface with a pressure sensitive adhesive thereon and a second surface. The dispenser includes a housing suitable for holding and dispensing a roll of tape. The housing has an exterior application surface that has a tape dispensing opening therein. A plurality of cylindrical rollers are provided within the housing, each roller having an outer surfaces. The outer surfaces of the rollers coact with each other and the tape surfaces to retain, guide and feed the tape through the tape dispensing opening to the exterior application surface. The outer surface of at least one of the rollers protrudes through the application surface on one side of the opening enabling frictional contact of the roller surface with the substrate surface. Thus, when the application surface of the tape dispenser is drawn or passes over the substrate surface in one direction the outer surface of the roller engages the substrate surface causing the roller to roll along the substrate surface and to coact and drive the outer surfaces other rollers. This causes the rollers to grip the surfaces of the tape and feed the tape through the opening enabling the first surface of the tape with the pressure sensitive adhesive thereon to contact the substrate surface and adhere thereto.

Optionally, the outer surface of another of the rollers protrudes through the application surface on the other side of the opening to contact the second surface of the tape as it is fed through the opening. Thus when the application surface of the tape dispenser passes over the substrate surface in the one direction the outer surface of this other roller contacts the second surface of the tape to apply pressure to the tape causing the first surface of the tape with the pressure sensitive adhesive thereon to adhere to the substrate. A cutting blade is mounted to the application surface on the one side of the opening, whereby when the dispenser is moved in a different direction to the one direction, the tape is cut by the blade. The cutting edge of the blade faces the interior of the housing.

BRIEF DESCRIPTION OF THE DRAWINGS

For a more complete understanding of the present invention, reference may be had to the following description of exemplary embodiments of the present invention considered in connection with the accompanying drawings, of which.

DETAILED DESCRIPTION OF THE INVENTION

Figure 1:
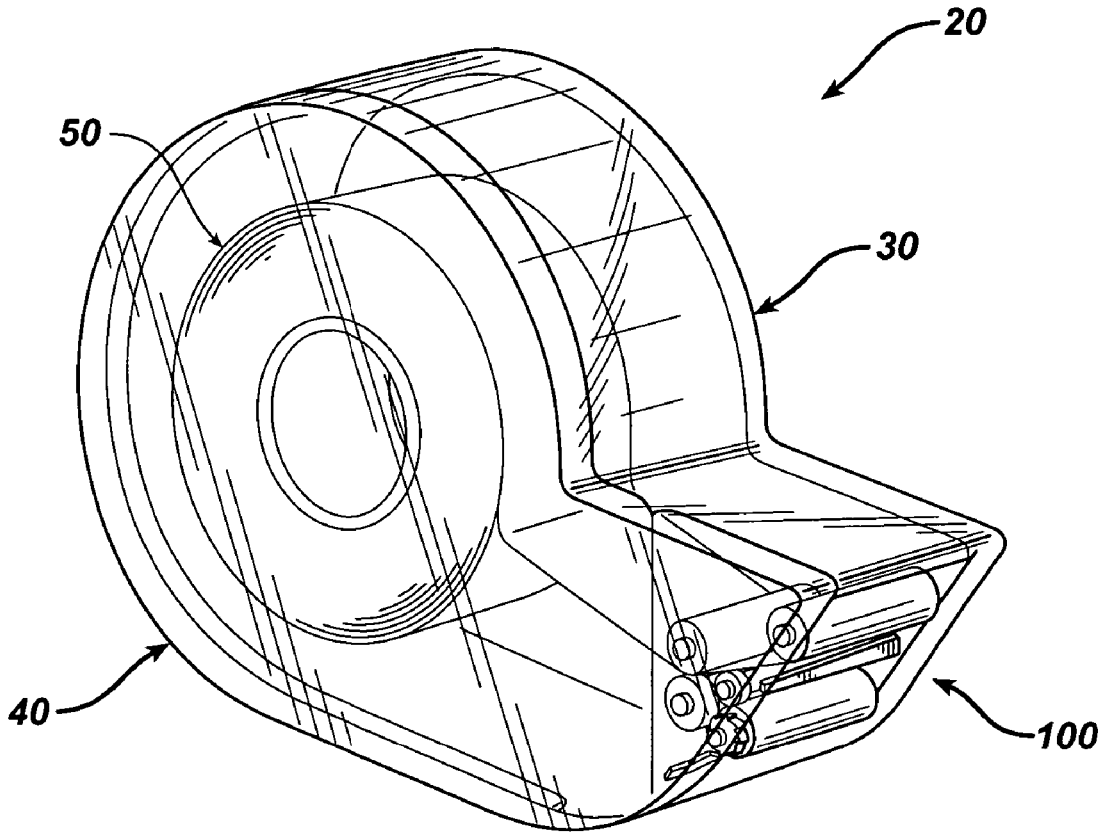
FIG. 1 is a perspective view of one embodiment of the tape dispenser of this invention that uses five rollers to retain, guide and feed the tape through the tape dispensing opening to the exterior application surface.
Figure 2:
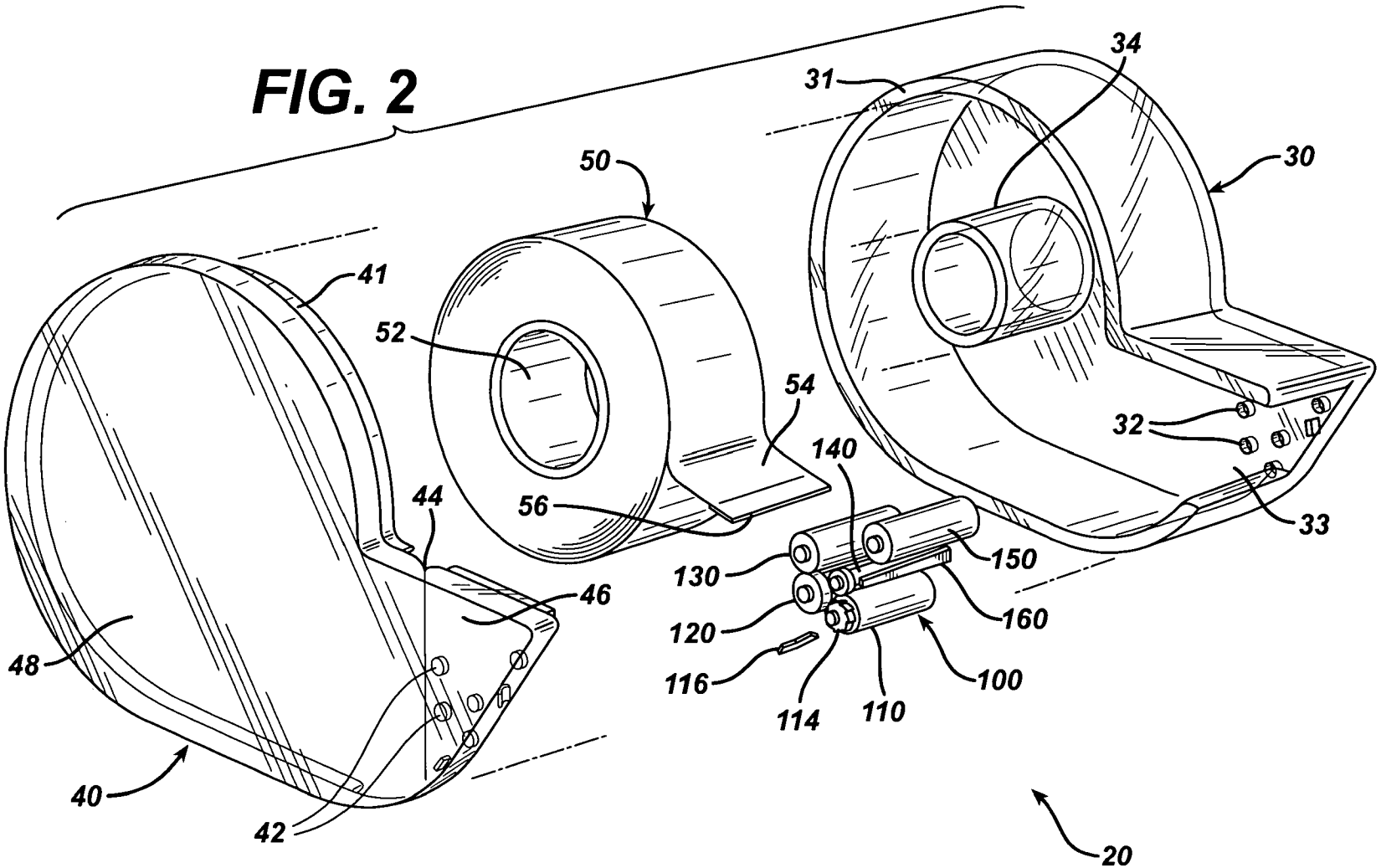
FIG. 2 is an exploded perspective view of the tape dispenser shown in FIG. 1.

Referring to FIGS. 1–5, and in particular FIG. 2, the tape dispenser 20 is comprised of a right housing member 30 and a left housing member 40. Preferably the housing members are made of a plastic material, although any other type material is contemplated, e.g., metal, wood, ceramic. The dispenser 20 can have finger grips (not shown), possibly from rubber, placed at the appropriate places for ease of holding and using the dispenser 20 with the hand H.

The housing members 30, 40 house the roll of tape 50, the roller assembly 100 consisting of a plurality of rollers 110, 120, 130, 140, 150, and the knife blade 160. The roll of tape 50 has a tape core 52 and tape 54 wrapped around the core 52. Preferably the tape 54 has a pressure sensitive adhesive on one surface, although the use of a tape having a double sided adhesive is contemplated.

Referring to FIG. 2, housing member 30 mates with housing member 40 along lips 31 and 41 of the respective housing members 30,40. If it is desired that the tape dispenser 20 be disposable than these members 30, 40 are permanently joined together along their lips 31, 41 to permanently hold the roll of tape 50 and roller assembly 100 therein.

Preferably, as shown in FIGS. 1–5, a rear portion 48 of the housing member 40 is removably joined to housing member 30 to permit the insertion and removal of the roll of tape 50 in operative position in the housing, i.e., with tape core 52 rotatably mounted on spindle 34 attached to the interior of housing member 30. The remaining front portion 46 of housing member 40 is permanently joined to the similar portion of housing member 30 to permanently maintain the roller assembly 100 and knife blade 160 in the housing. As shown more clearly in FIG. 2, housing members 30, 40 are removably mated along a portion of their lips 31, 41, for example, by interlocking lips 31, 41. The remaining portion of the lips 31, 41, are permanently joined, e.g., glued, together to permanently capture the roller assembly 100 and knife blade 160 between the housing members 30, 40. At a point near the roller assembly 100 a vertical hinge member 44, e.g., a score line of thinner plastic, is included in housing member 40 to permit the rear portion 48 of housing member 40 to be swung away from the rear portion of housing member 30 to permit the removal of the tape roll 50 from spindle 34.

Figure 10:
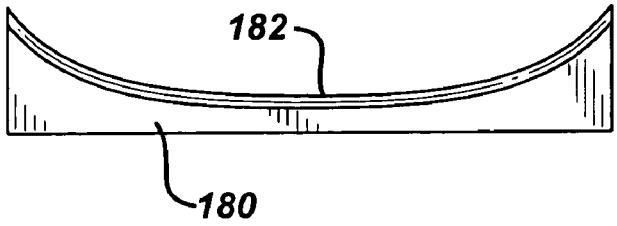
FIG. 10 is a front view of another embodiment of a cutting blade used in the dispenser of this invention.
Figure 11:
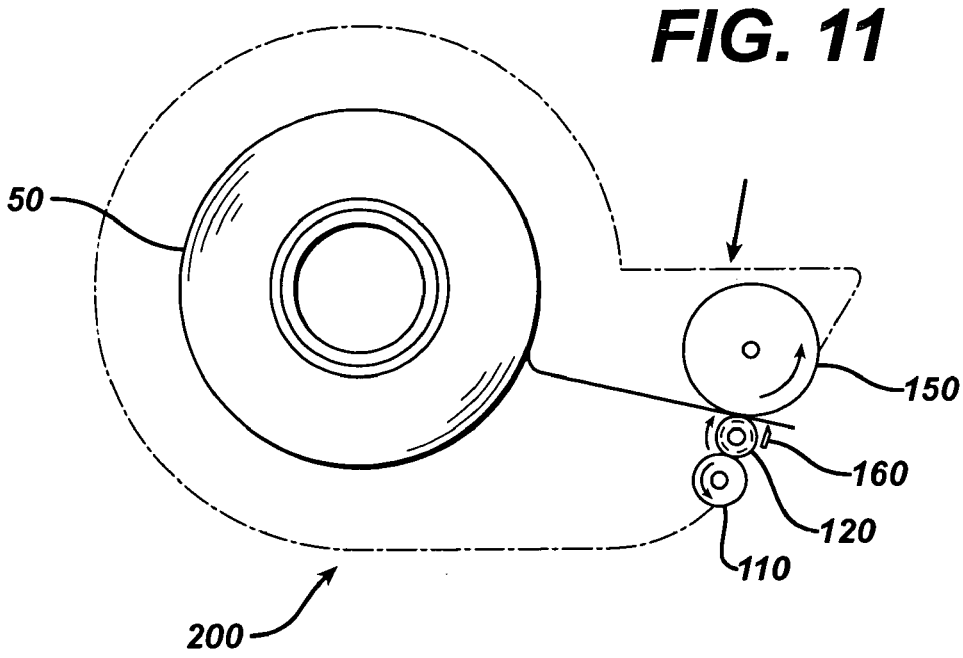
FIG. 11 is a schematic side view of another embodiment of the tape dispenser of this invention that uses three rollers to retain, guide and feed the tape through the tape dispensing opening to the exterior application surface.

Referring to FIGS. 1 and 2 for example, the dispenser 20 has therein an opening 33 therein for dispensing tape 54 therethrough. A drive roller assembly 100 is provided in the dispenser that traverses this opening 33. In the embodiment depicted in FIGS. 1–10 the drive roller assembly comprises five rollers, i.e., a first drive roller 110, a second drive roller 120, a third drive roller 130 a support roller 140 and a pressure roller 150. Although this is the preferred drive roller assembly configuration 100 for optimum tape feed and control, other configurations are contemplated. Referring to FIG. 11, a drive roller assembly comprising three rollers is depicted, i.e., a first drive roller 110, a second drive roller 120, and a pressure roller 150. Additionally, referring to FIG. 12, a drive roller assembly comprising two rollers is depicted, i.e., a drive roller 150 and a guide roller 170.

Referring to FIG. 2, each of the rollers 110, 120, 130, 140, 150 is cylindrical and is adapted to freely rotate about its axis. At each end of each roller 110, 120, 130, 140, 150 is a nub that rotatingly mates within openings 32 in housing 30 and openings 42 in housing 40. Optionally, the nubs are the ends of a rod that passes through each roller and are fixed in the openings 32 and 42 and the rollers rotate about the axis of a fixed rod through their center. When the housings 30 and 40 are affixed to each other they permanently entrap the roller assembly 100. This same structure of entrapping the rollers within the housing may be used in the embodiments depicted in FIGS. 11 and 12.

Referring to FIGS. 1–8, the outer surfaces of each the rollers 110, 120, 130, 140, 150 coact with each other and the tape surfaces 54*a*, 54*b* to retain, guide and feed the tape 54 through the tape dispensing opening 33 to the exterior application surface P, e.g., a package surface. The outer surface of at least one of the rollers, in particular drive roller 110 (see FIG. 4) protrudes through the opening 33 on one side thereof enabling frictional contact of the roller 110 surface with the substrate surface P.

Figure 3:
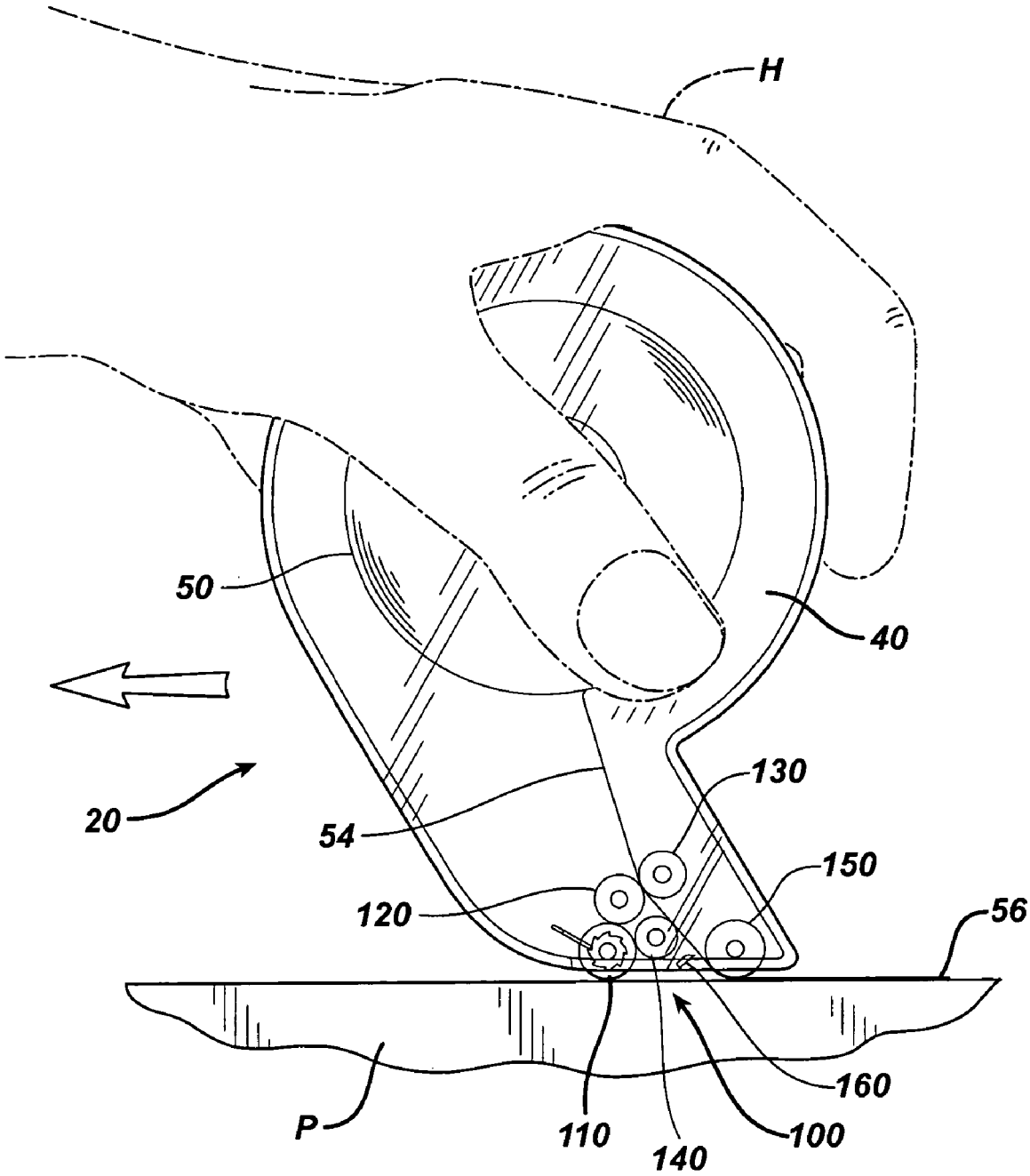
FIG. 3 is a side view of the embodiment of the tape dispenser shown in FIG. 1 being drawn over the substrate surface to which the tape is to be applied.
Figure 4:
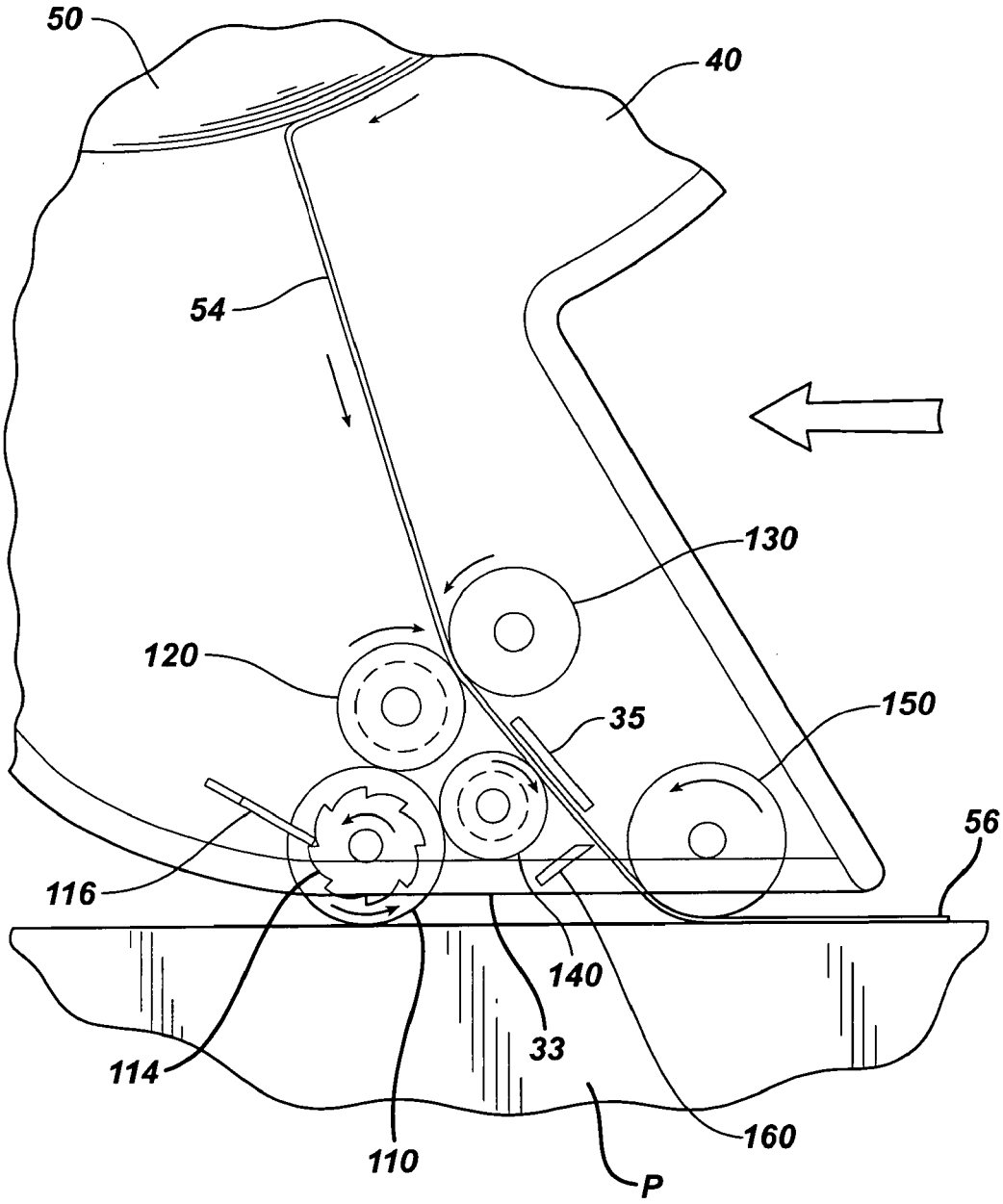
FIG. 4 is a schematic side view of a portion of the embodiment of the tape dispenser shown in FIG. 1 being drawn over the substrate surface to which the tape is to be applied.

Referring to FIGS. 3 and 4, when the tape dispenser 20 is drawn over the substrate surface P in one direction (the arrow to the left) the outer surface of the drive roller 110 engages the substrate surface P causing the roller 110 to roll in a counterclockwise direction along the substrate surface P. Roller 110 then coacts with and drives the outer surfaces of rollers 120 and 140 in a clockwise direction. These rollers 120 and 140 grip the adhesive surface 54*b* of the tape 54 and feed the tape end 56 through the opening 33. Drive or guide roller 130 is in contact with tape surface 54*a* to assist in maintaining the tape surface 54*b* against roller 120 so that it can feed the tape 54. Roller 130 is driven in a counterclockwise direction by the movement of tape surface 54*a* across the surface of the roller.

Optionally, as depicted FIGS. 3 and 4, in the outer surface of roller 150 protrudes through the opening 33 on the other side of the opening to contact the second surface of the tape 54*a* as it is fed through the opening 33. Thus when the tape dispenser 20 is drawn over the substrate surface P in the direction of the arrow (left) the outer surface of this roller 150 contacts the second surface 54*a* of the tape to apply pressure to the tape 54 causing the first surface of the tape 54*b* with the pressure sensitive adhesive thereon to adhere to the substrate P.

Like wise in the three roller configuration shown in FIG. 11, when the tape dispenser is drawn over the substrate surface the outer surface of the drive roller 110 engages the substrate surface causing the roller 110 to roll in a counterclockwise direction. Roller 110 then coacts with and drives the outer surface of roller 120 in a clockwise direction. Roller 120 grips the adhesive surface 54*b* of the tape 54 to feed the tape end 56 through the opening 33. Pressure roller 150 is in contact with tape surface 54*a* to assist in maintaining the tape surface 54*b* against roller 120 so that it can feed the tape 54. Pressure roller 150 is driven in a counterclockwise direction by the movement of tape surface 54*a* across the surface of the roller to press the tape onto the substrate P.

Figure 12:
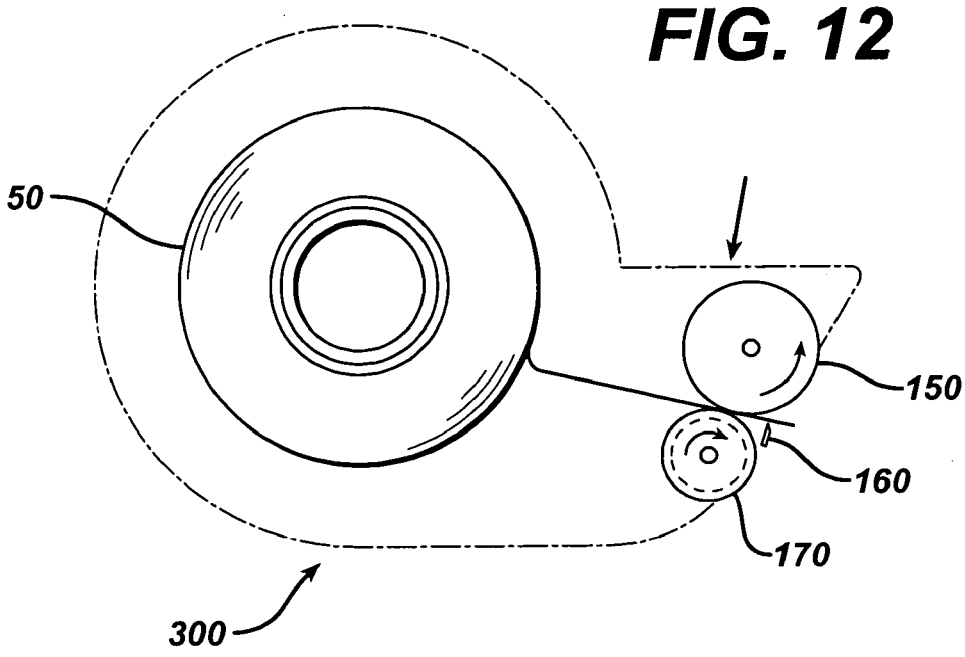
FIG. 12 is a schematic side view of another embodiment of the tape dispenser of this invention that uses two rollers to retain, guide and feed the tape through the tape dispensing opening to the exterior application surface.

Similarly in the two roller configuration shown in FIG. 12, when the tape dispenser is drawn over the substrate surface the outer surface of the drive roller 150 engages the substrate surface causing the roller 150 to roll in a counterclockwise direction. Roller 150 then coacts with the tape surface 54*a* to feed the tape end 56 through the opening 33. Roller 170 is in contact with tape surface 54*b* to assist in maintaining the tape surface 54*a* against roller 150 so that it can feed the tape 54. Roller 170 does not contact substrate P. Roller 150 is then rolled across tape surface 54*a* to press the tape onto the substrate P.

There are advantages and disadvantages to each configuration of rollers. In general, the more rollers there are in the roller assembly, the more flexibility and control the user has of the tape feed and application. The less rollers there are in the roller assembly, the less complex and costly the dispenser.

Referring to FIG. 4, optionally a guide member 35 may used to guide the tape 54 through the rollers. The guide 35 can be molded from the side of one of the housing members 30, 40.

Figure 5:
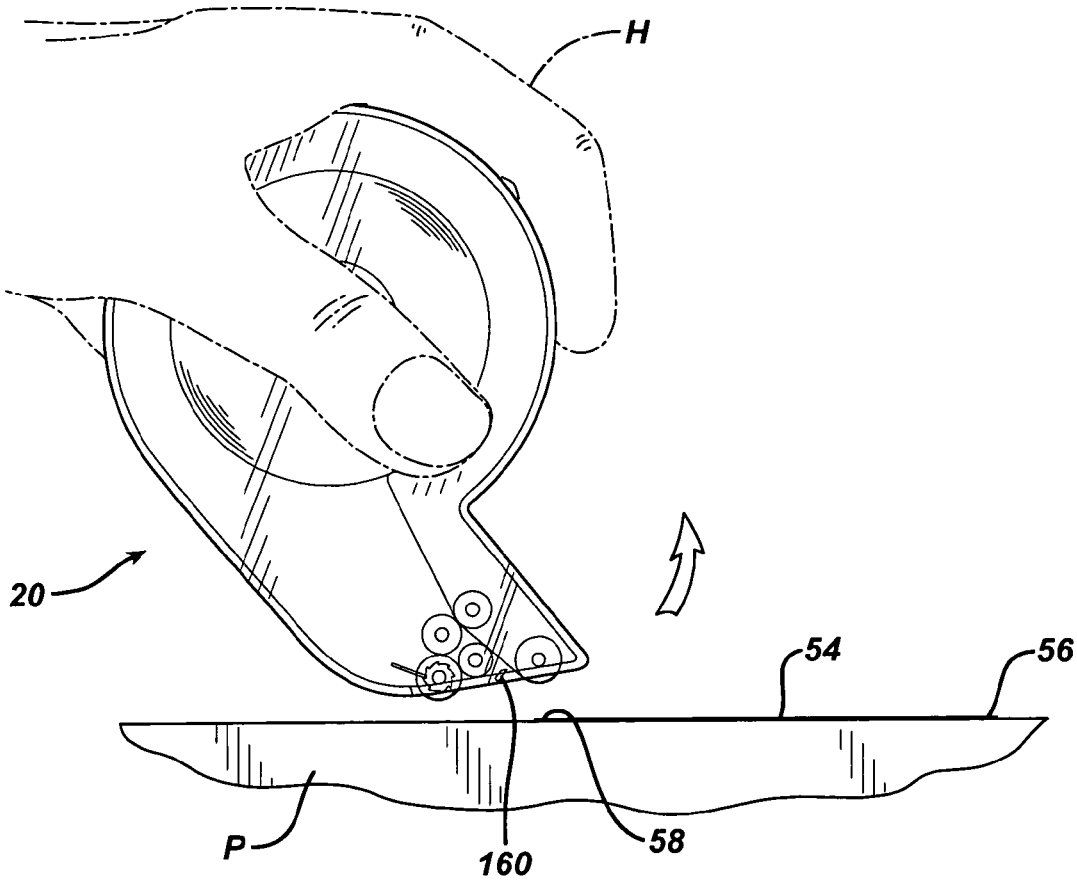
FIG. 5 is a side view of the embodiment of the tape dispenser shown in FIG. 1 after the dispenser has applied the tape to the substrate and has cut the tape.
Figure 9:
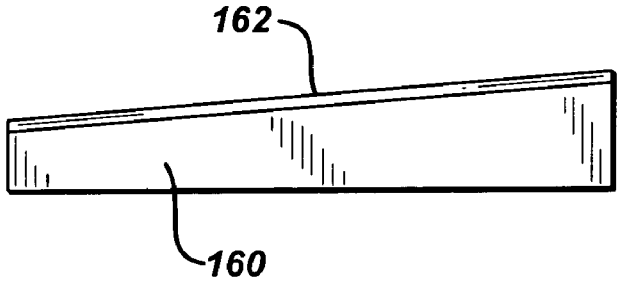
FIG. 9 is a front view of one embodiment of a cutting blade used in the dispenser of this invention.

As best seen in FIG. 4, a cutting blade 160 is mounted across the opening 33 on one side of thereof. As depicted in FIG. 2, each end of the blade is mounted in an opening 32, 42 of the respective housing member 30, 40. The angle at which the blade 160 addresses the tape 54 does not seem to be critical. FIGS. 9 and 10 show two embodiments of the blade used to cut the tape 54. FIG. 9 shows a straight blade 160 with cutting edge 162. FIG. 10 shows a curvilinear blade 180 with cutting edge 182. These type blades can easily cut tape 54. The roller assembly 100 should be arranged in such a way that the sharp edge of the blade 162, 182 faces into the dispenser 20 housing making it safe. Such a configuration makes the dispenser very safe to use in that there is minimal chance to cut someone using it. Referring to FIG. 5, after application of the desired length of tape one merely lifts the dispenser 20 (arrow) or moves it slightly in the opposite direction to cut the tape 54 with the knife blade 162.

The rollers can be arranged in a number of ways. They can be positioned in different locations in the device and be of various sizes. The number of rollers used can also vary. These things would be determined partially by the shape of the 'taper' front-end design desired and the cutting blade placement.

The individual rollers are configured to perform the function that they must perform. For example, referring to FIG. 4, it is preferred that roller 110 have a high coefficient of friction between the roller surface and the substrate P so that it can be driven by merely rolling over surface P. Therefore it is preferred that the roller surface be made of a rubber/polymeric type material that grips substrate P. On the other hand, although it is desirable that rollers 150 and 130 also have a rubbery texture, this is not as critical.

Figure 6:
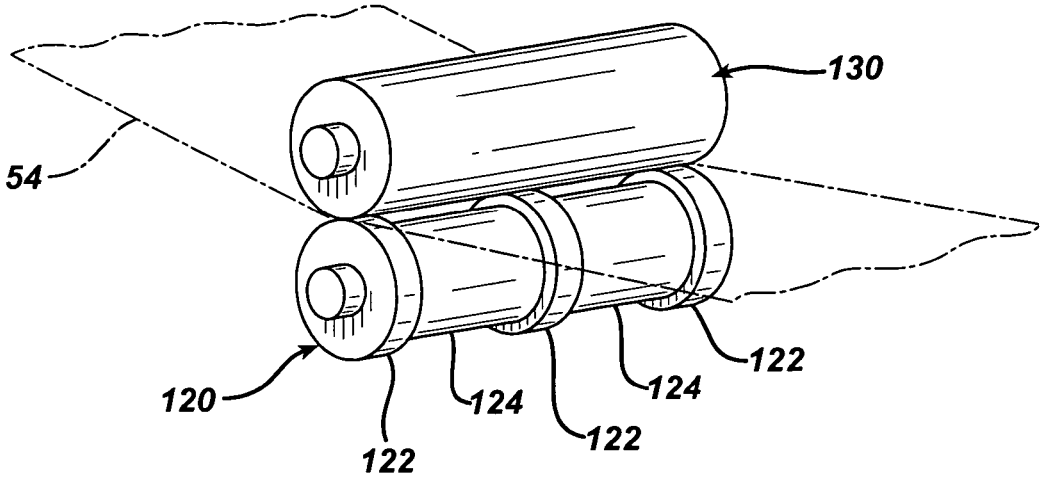
FIG. 6 is a perspective view of one embodiment of two of the rollers in the tape dispenser housing that grip the surfaces of the tape to assist in feeding the tape through the dispenser opening.
Figure 7:
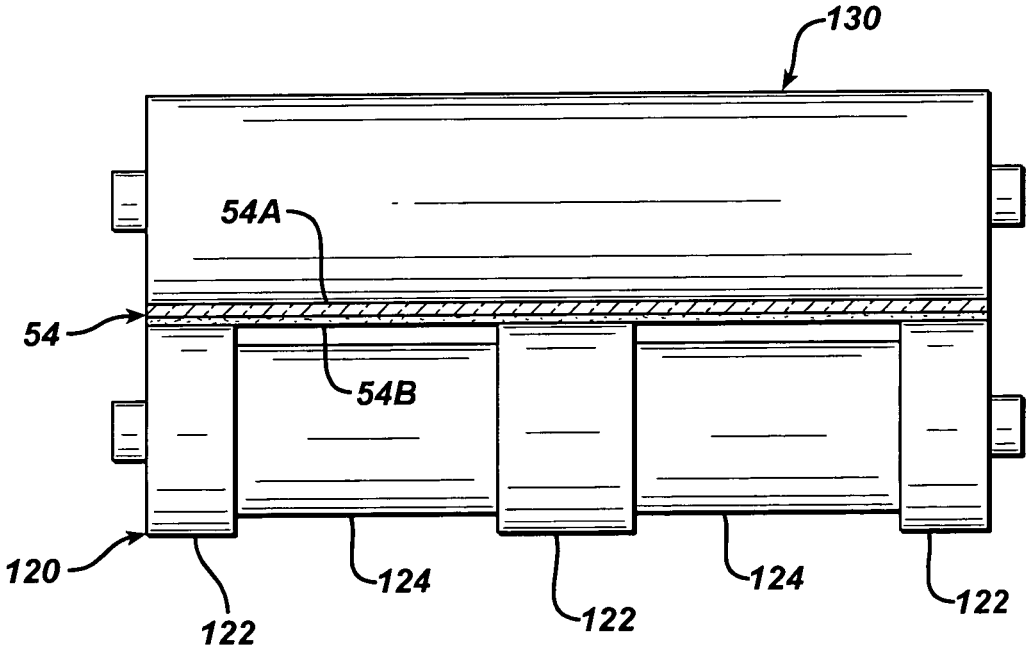
FIG. 7 is a front view of the two rollers shown in FIG. 6 that grip the surfaces of the tape.
Figure 8:
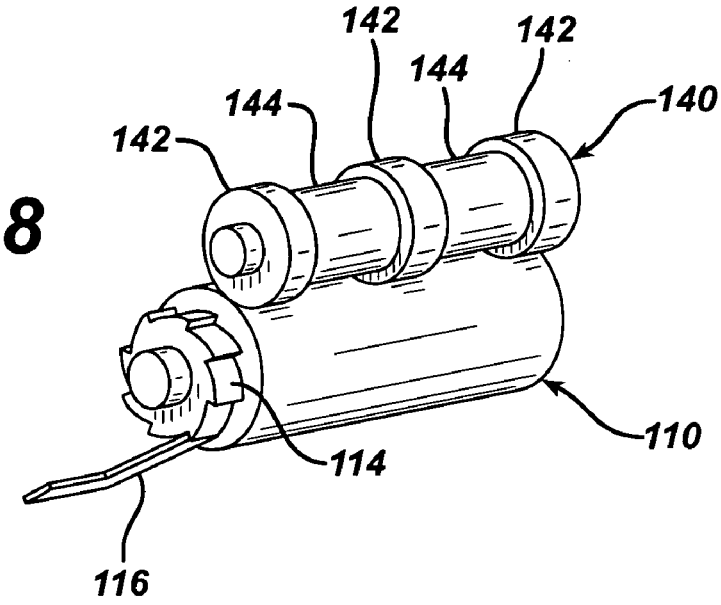
FIG. 8 is a perspective view of another embodiment of two of the rollers in the tape dispenser housing that grip the surfaces of the tape to assist in feeding the tape through the dispenser opening.

Rollers 120 and 140 are of similar design. This design is depicted in FIGS. 6, 7 and 8. These Figures show roller 120 being substantially similar to roller 140. The outer surface of rollers 120 and 140 are in contact with the adhesive side 54*b* of tape 54. Preferably they are shaped to minimize the contact of the roller surface with tape surface 54*b*. Preferably the outer surface is smooth. Additionally, it is shaped to reduce contact of the roller surface with the adhesive side 54*b* of the tape 54. This is done by the use of a reduced diameter 124 over a major portion of the roller surface so that the tape surface 54*b* only rests on ridges 122. This structure prevents the tape surface 54*b* from sticking to the roller as it passes through the roller assembly 100. If a double-sided tape is used, rollers 130 and 150 are preferably be the same structure as rollers 120 and 140.

This invention has many advantages. In particular, it solves the 'dangling tape' problem. This is solved by cutting the tape 54 so that the tape end remains in the dispenser 20 (See FIGS. 4 and 5) and thus cannot be seen or touched. The roller assembly 100 then feeds the tape 54 so that it is fed through opening 33 onto the substrate P as the dispenser moves to the left as depicted in FIGS. 3, 4, 5.

The dispenser of this invention is also designed to control the tape at all times. Referring to FIGS. 3, and 8, to prevent the tape 54 from moving back into the housing of the dispenser 20, roller assembly 100 has roller 110 on one end of it fitted with a ratchet gear 114 and a ratchet stop 116 that engages the ratchet gear 114 if roller 110 rotates clockwise rather than the desired counterclockwise direction. This ratchet gear 114 and roller 110 can be molded as one piece, reducing manufacturing and assembly cost. The ratchet stop 116 can also be molded as one piece with the housing member 30 or 40.

Optionally, guides may be used for some of the rollers. For example, referring to FIG. 4, a guide can be substituted for roller 140 in guiding the tape 54. These guides can be molded as part of the housing 30, 40., thus reducing the cost of the dispenser.

Preferably, the dispenser has finger grips on the outside (not shown) to promote ease of use.

Referring to FIGS. 3, 4 and 5, to apply the tape 54 to a surface P, a hand H grips the dispenser 20 and places it on the surface P so that rollers 110 and 150 are on the surface P. The dispenser 20 is moved along the surface P to be taped (right to left in FIG. 3). Roller 110 moves counter-clockwise causing the tape 54 to be moved down and under roller 150. When the tape has been applied, the dispenser 20 is lifted up, off of the surface P, thereby cutting the tape 54 with the blade 160. The beginning if the tape 56 is now out of the way, inside the dispenser 20 ready for the next use.

OTHER EMBODIMENTS

Figure 13:
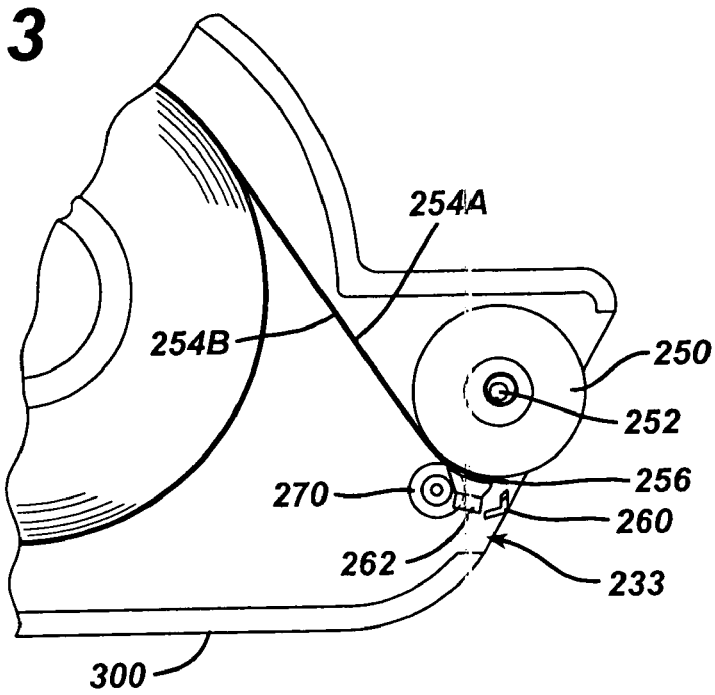
FIG. 13 is a schematic side view of another embodiment of the tape dispenser of this invention that uses two rollers to retain, guide and feed the tape through the tape dispensing opening to the exterior application surface.
Figure 14:
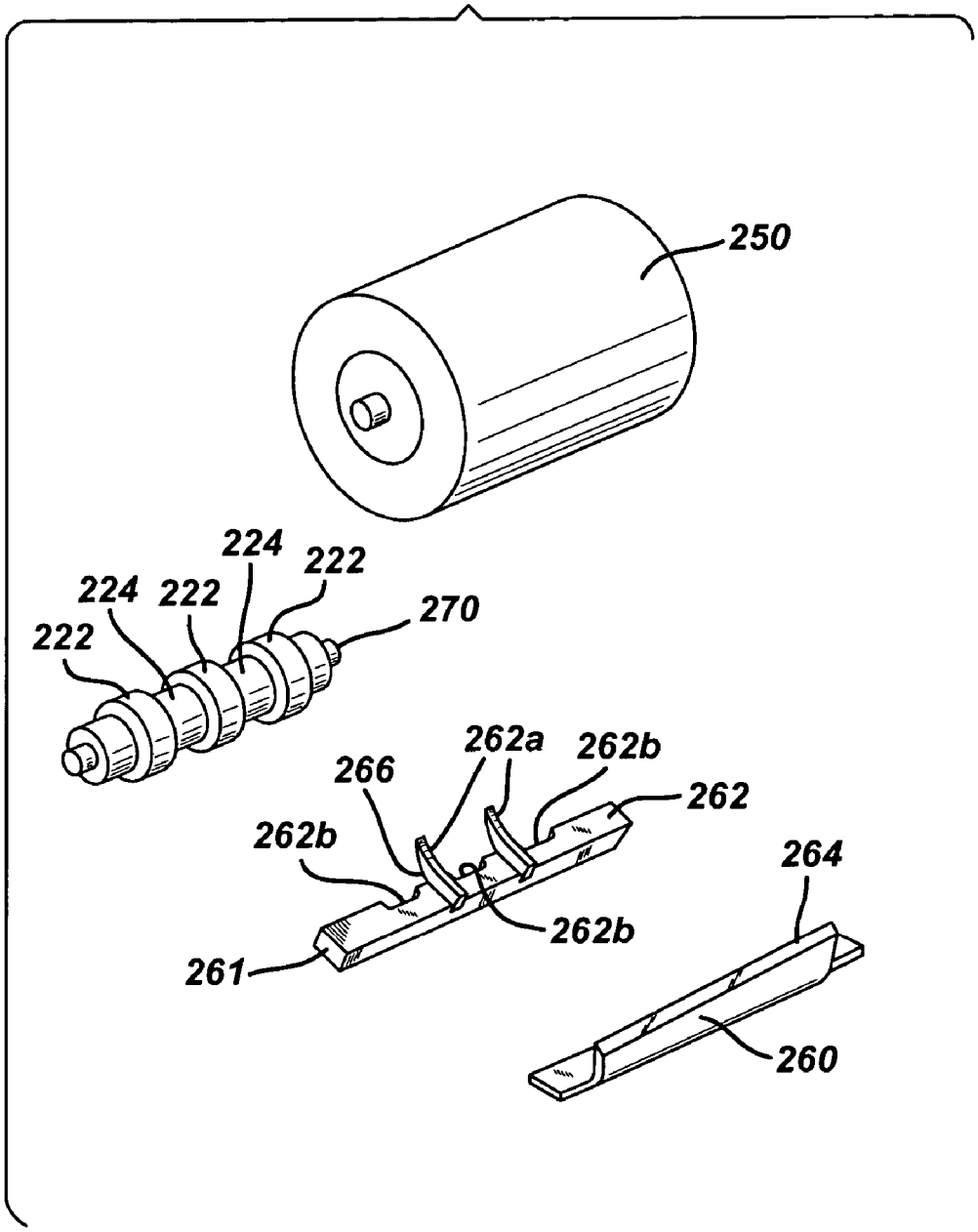
FIG. 14 is an exploded perspective view of the rollers, guide and knife blade in the tape dispenser shown in FIGS. 13 and 13A.
Figure 15:
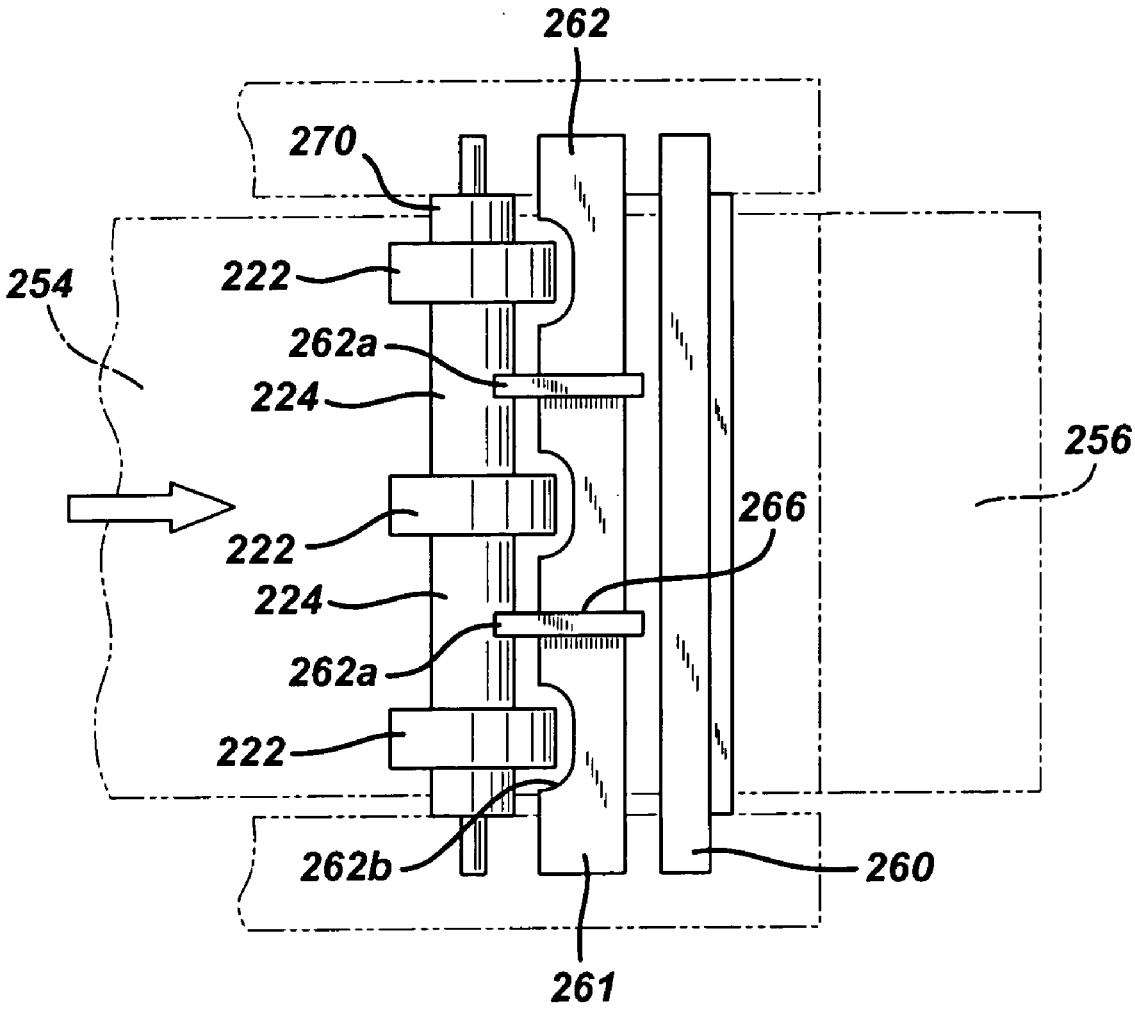
FIG. 15 is an enlarged view of the assembled rollers, guide and knife blade in the tape dispenser of FIGS. 13 and 13A taken along line 15—15 in FIG. 13A.

Referring to FIGS. 13–15, another embodiment of the two roller configuration is depicted. In this embodiment when the tape dispenser 300 is drawn over the substrate surface, the outer surface of the drive roller 250 engages the substrate surface causing the roller 250 to roll in a counterclockwise direction. Roller 250 then coacts with the tape surface 254*a* to feed the tape end 256 through the opening 233. Follower roller 270 then contacts tape surface 254*b* to assist in maintaining the tape surface 254*a* against roller 250 so that it can feed the tape 254 onto the surface being taped. Roller 270 does not contact the substrate. Roller 250 is then rolled across tape surface 254*a* to press the tape onto the substrate.

The outer surface of roller 270 is in contact with the adhesive side 254*b* of tape 254. Preferably, roller 270 is smooth and shaped to minimize the contact of the roller surface with tape surface 254*b*. Referring to FIGS. 14 and 15, this is done by the use of a reduced diameter 224 over a major portion of the roller 270 surface so that the tape surface 254*b* only rests on ridges 222. This structure minimizes the sticking of the tape surface 254*b* to the roller 270 as the tape 254 passes through the roller assembly.

If a tape is used wherein there is an adhesive on both sides of the tape, it may also be desirable to have a drive roller 250 that is shaped to minimize the contact of the drive roller 250 surface with tape surface 254*a*. Although not shown in the Figures, this roller could look very similar to the follower roller 270 depicted in FIGS. 14 and 15. The roller 250 would have a reduced diameter over a major portion of the roller surface so that the tape surface 254*a* only rests on ridges that encircle the drive roller 250. Such a roller structure would minimize the sticking of the tape surface 254*a* to the roller 250 as the tape 254 passes through the roller assembly.

Referring to FIGS. 14 and 15, the embodiment depicted additionally has a tape guide 262. The tape guide 262 has fingers 262*a* and positioning grooves 262*b* which function to position the tape guide 262 and guide the tape 254 and further prevent the tape 254 from sticking to ridges 222. As roller 270 rotates, the fingers 262*a* coact with the roller 270 and tape 254 to insure that the tape 254 does not adhere to the roller surfaces 222. The tape guide fingers 262*a* are narrow at the point of contact with the sticky side of the tape 254*b* thus minimizing or preventing the tape from sticking to the guide 262. Thus the ridges 222 of roller 270 contact adhesive tape surface 254*b* but maintain minimum contact therewith. The guide 262 also contacts adhesive tape surface 254*b* but again with only minimum contact.

Figure 13A:
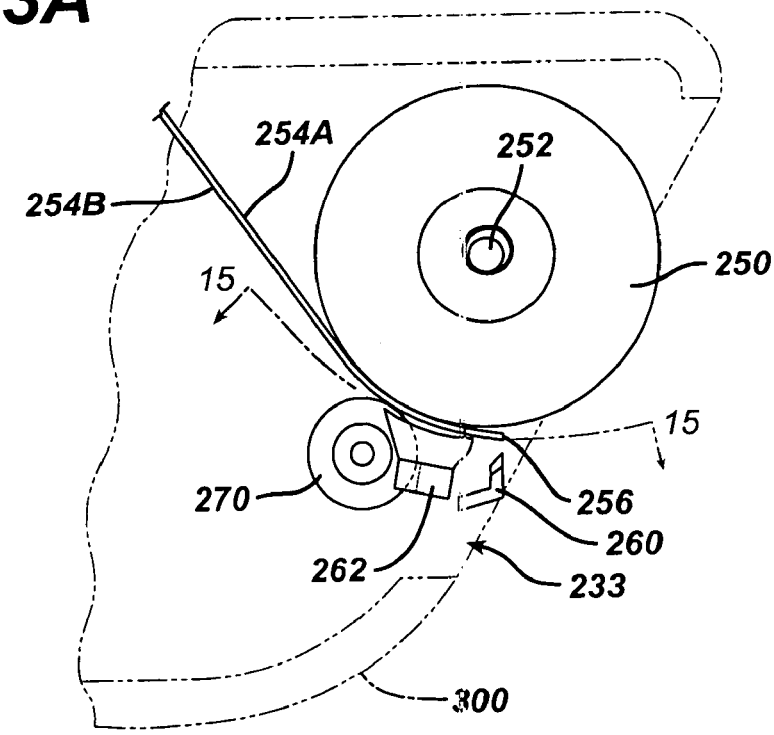
FIG. 13A is an enlarged schematic side view of a portion of the embodiment of the tape dispenser shown in FIG. 13.

The guide 262 is positioned close to the other roller 250, however there is sufficient space between the roller 250 surface and the guide 262 to permit the passage of the tape 254 therebetween (see FIG. 13A). Thus, guide 262 prevents the tape end 256 from attaching to the roller 270 surfaces and guides the tape end 256 along the guide finger 262*a* forcing the tape end 256 to pass under roller 250. The roller 250 then presses the tape end 256 onto the surface being taped.

The assembly additionally includes a cutting blade 260 that is aligned substantially parallel to the guide 262 and rollers 250, 270.

Referring to FIGS. 14 and 15, the bottom surfaces 266 of fingers 262*a* are shaped (e.g., slightly curved). The tape 254 while passing over the guide 262 and fingers 262*a* is directed to the cutting blade 262. The fingers 262*a* are also sufficiently close to the surface of roller 250 so that the beginning of the tape 256 will move underneath roller 250 when the dispenser is again used.

The guide 262 is kept in place with the guide holder 261 which can be part of the dispenser case 300, preferably maintaining guide 262, rollers 250, 270 and cutting blade 260 in position.

The guide 262 described herein allows greater flexibility in the placement of rollers 250, 270 and cutting blade 260. The rollers 250, 270 can be of different sizes and can be placed more flexibly because the guide 262 will guide the tape end 256 to the desired position under roller 250 and unto the surface to be taped. The guide 262 also permits the roller 270 to be positioned so that there is more room for the cutting blade 260 and permits the cutting blade 260 to be placed at an appropriate angle, preferably with the sharp edge 264 angled inward for safety (see FIG. 14).

Different tapes have various amounts of adhesion (stronger and weaker adhesion) and various amounts of tape stiffness. When the adhesive is strong, less contact is permitted between the roller 270 and the adhesive tape surface 254*b*. The specific tape guide described herein permits the use of different types of tapes and types of rolls and can accommodate the variable properties that inevitably exist between tape rolls without having to design an assembly for each roll. This tape guide also permits the tape to move through the desired path with complete reliability. This is especially useful for tape dispensers used for packing boxes because the user can load many various types of tape into the same tape dispenser.

Referring to FIGS. 13 and 13A, roller 250 is mounted on shaft or pin 252. Pin 252 is mounted in such a manner and/or made from materials such that when roller 250 is placed on a surface and pressed down, the roller 250 moves toward the follower roller 270 and pinches the tape 254 between the two rollers 250, 270. The pin or shaft 252 acts as a resilient fulcrum. This can be accomplished by having a resilient pin 252 and/or a pin 252 that fits loosely through the center of roller 250. Thus, when the assembly is not being used and roller 250 is not being pressed against a surface, roller 250 and 270 are sufficiently close to each other to maintain the tape 254 in position. Pushing the roller 250 on the surface to be taped moves the rollers 250, 270 closer together to grip the tape. The pin or shaft 252 can be a separate element or molded with the assemble housing.

The forgoing structure has numerous advantages:

The tape guide 262 provides for reliable operation, e.g., the tape 254 will not stick to and go around follower roller 270.

The tape guide 262 guides tape 254 against roller 250 and guides the tape 254 toward the the surface being taped.

The tape guide 262 allows greater flexibility in placement of rollers and cutting blade.

The tape guide 262 permits one design to handle many different tape types with various amounts of adhesion (stronger and weaker adhesion) without having to design a new assembly for each. This is especially useful for 'packaging dispenser' because user can load many various types of tape.

The pin or shaft 252 and roller 250 act as fulcrum to permit the rollers 250, 270 to move toward each other so that the tape can be gripped therebetween and applied to the surface to be taped.

Figure 16:
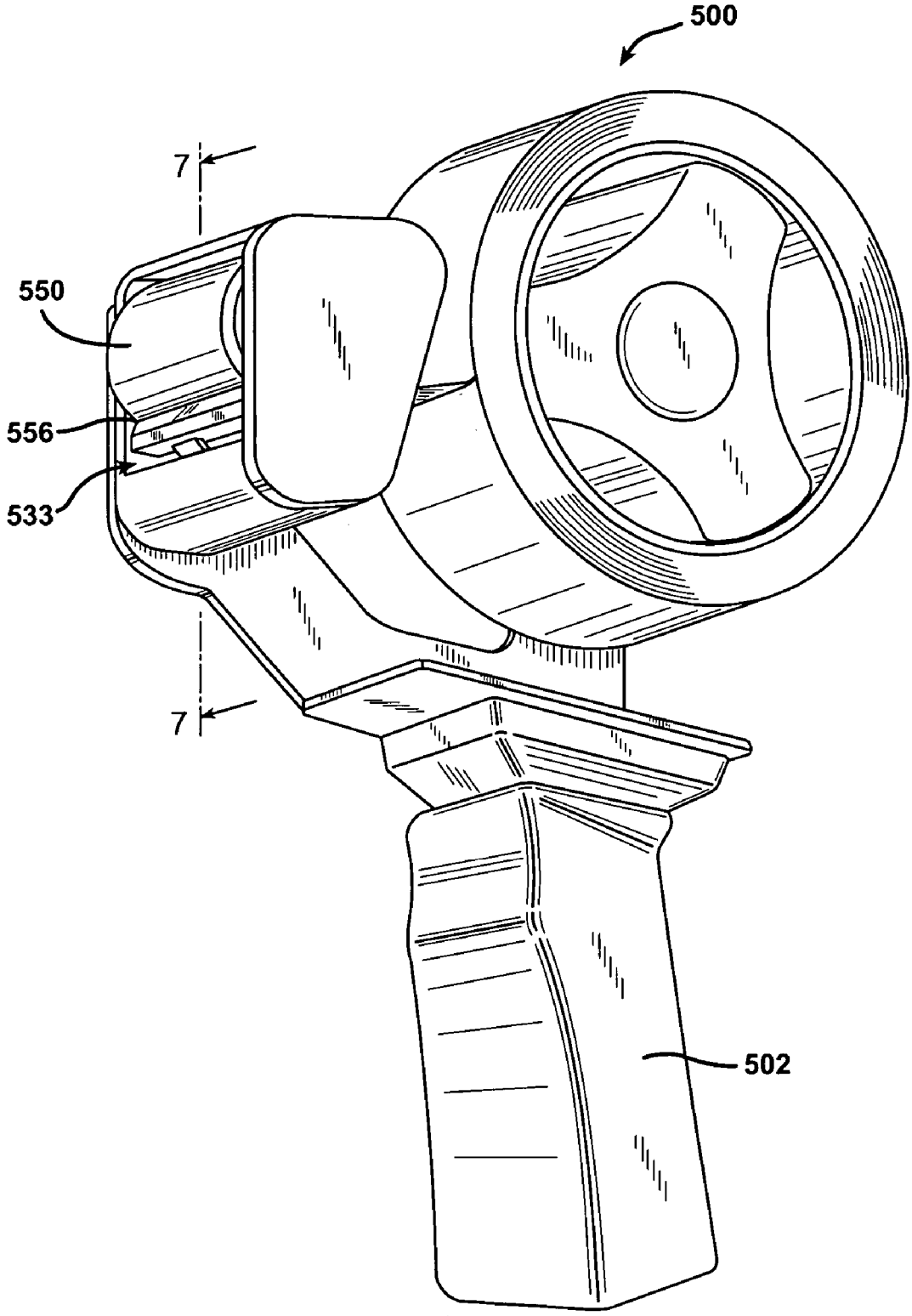
FIG. 16 is a perspective view of another embodiment of the packing tape dispenser of this invention that uses two rollers to retain, guide and feed the tape through the tape dispensing opening to the exterior application surface.
Figure 17:
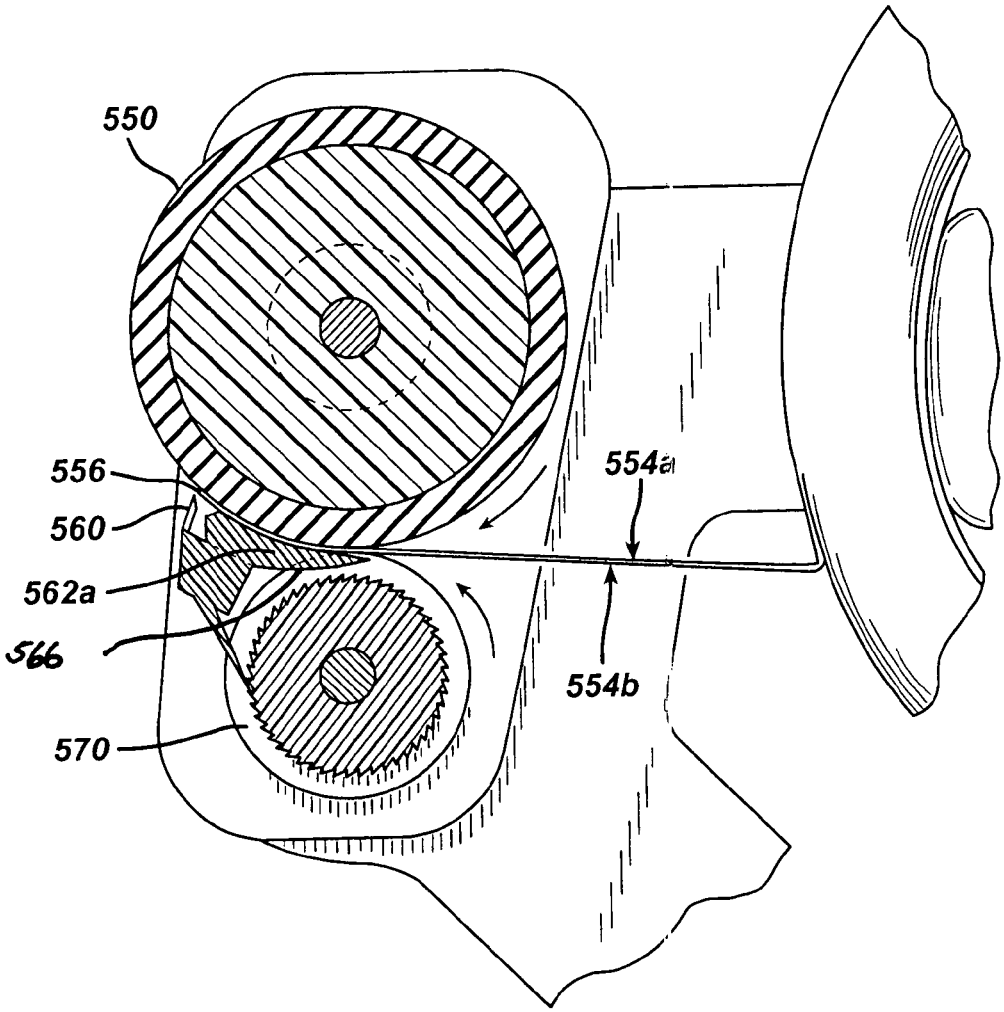
FIG. 17 is a cross-sectional side view of the embodiment of the tape dispenser shown in FIG. 16 taken along line 17—17.
Figure 18:
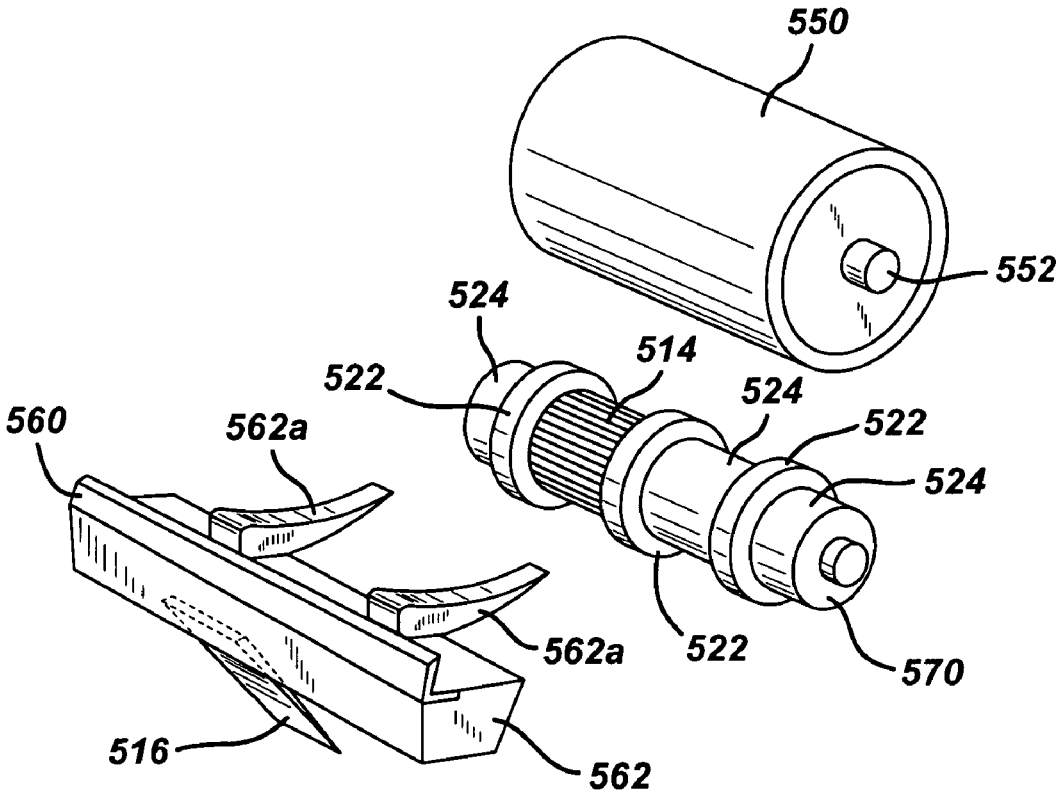
FIG. 18 is an exploded perspective view of the rollers, guide and knife blade in the tape dispenser shown in FIG. 16.

Referring to FIGS. 16–18, another embodiment of the two roller configuration is depicted. In this embodiment tape dispenser 500 is a tape dispenser used for packing. The dispenser 500 includes a handle 502 attached thereto. Generally, the structure and function of this packing tape dispenser 500 is similar to the dispenser 300 depicted in FIGS. 13–15.

As the dispenser 500 is drawn or passes over the substrate surface, the outer surface of the drive roller 550 engages the substrate surface causing the roller 550 to roll, in this case, in a clockwise direction. Roller 550 then coacts with the tape surface 554*a* to feed the tape end 556 through the opening 533. Follower roller 570 then contacts tape surface 554*b* to assist in maintaining the tape surface 554*a* against roller 550 so that it can feed the tape 554 onto the surface being taped. Roller 570 does not contact the substrate to be taped. Roller 550 is then rolled across tape surface 554*a* to press the tape onto the substrate.

The outer surface of follower roller 570 is in contact with the adhesive side 554*b* of tape 554. Referring to FIG. 18, roller 570 is smooth and shaped to minimize the contact of the roller surface with tape surface 554*b*. Referring to FIGS. 18, and as described previously, this is done by the use of a reduced diameter 524 over a major portion of the roller 570 surface so that the tape surface 554*b* only rests on ridges 522.

Similar to the embodiment depicted in FIGS. 13–15, the embodiment depicted in FIGS. 16–18, has a tape guide 562. The tape guide 562 has fingers 562*a* which function to guide the tape 554 and further prevent the tape 554 from sticking to ridges 522. As roller 570 rotates the fingers 562*a* "sweep" over the roller 570 to insure that the tape 554 does not adhere to the roller surfaces on 522 and 524. Specifically, the fingers 562*a* are in sliding contact with the reduced diameter 524 of roller 570. The tape guide fingers 562*a* are narrow at the point of contact with the sticky side of the tape 554*b* thus minimizing or preventing the tape from sticking to the guide 562. Thus the ridges 522 of roller 570 contact adhesive tape surface 554*b* but maintain minimum contact therewith. The guide 562 also contacts adhesive tape surface 554*b* but again with only minimum contact.

Referring to FIG. 17, the guide 562 is positioned close to the other roller 550, however there is sufficient space between the roller 550 surface and the guide 562 to permit the passage of the tape 554 therebetween. Thus guide 562 prevents the tape end 556 from attaching to the roller 570 surfaces and guides the tape end 556 along the guide finger 562*a* forcing the tape end 556 to pass under roller 550. The roller 550 then presses the tape end 556 onto the surface being taped.

The guide 562 also includes a cutting blade 560 attached to the guide and aligned substantially parallel to the rollers 550, 570.

Referring to FIG. 17, the bottom surfaces 566 of fingers 562*a* are shaped (e.g., slightly curved) so that as the tape 554 while passing over the guide 562 is directed to the cutting blade 560. The bottom surfaces 566 are also sufficiently close to the bottom of roller 550 so that the beginning of the tape 556 will move underneath roller 550 when the dispenser is again used.

Referring to FIGS. 17 and 18, similar to the applicator previously described, roller 550 is mounted on pin 552. Pin 552 is mounted in such a manner and/or made from materials such that when roller 550 is placed on a surface and pressed down, the roller 550 moves toward the follower roller 570 and pinches the tape 554 between the two rollers 550, 570. The pin 552 acts as a resilient spring or fulcrum. When the assembly is not being used and roller 550 is not being pressed against a surface, roller 550 and 570 are sufficiently close to each other to maintain the tape 554 in position.

The dispenser of this invention is also designed to control the tape 554 at all times. Referring to FIGS. 17 and 18, to prevent the tape 554 from moving back into the assembly, roller 570 includes roller portion 524 with a ratchet gear 514 and tape guide 562 includes a ratchet stop 516 that engages the ratchet gear 514 if roller 570 rotates clockwise rather than the desired counterclockwise direction. This ratchet gear 514 and roller 570 can be molded as one piece, reducing manufacturing and assembly cost. The guide 562, 562*a* and 562*b*, ratchet stop 516, and cutting blade 560 can also be molded as one piece and/or be molded integrally with the housing.

The applicator of this invention may be used for cellophane tape, packaging tape, desktop tape, masking tape and even tape having an adhesive on both sides. The applicator may not only be the types shown herein, but may be a desk top type that can be picked up and used as an applicator, a large package applicator with or without a handle ("pistol grip") and may be an industrial sized applicator wherein the applicator is moved to apply the tape or the package is moved over the applicator to apply the tape.

It will be understood that various changes in the details, arrangements and configuration of the parts and assemblies which have been described and illustrated may be made by those skilled in the art within the principle and scope of the present invention.

What is claimed is:

1. A handheld tape dispenser for applying tape to a substrate surface, the tape having a first surface with a pressure sensitive adhesive thereon and a second surface, the dispenser comprising:

a housing suitable for holding and dispensing a roll of tape, the housing including an exterior application surface having a tape dispensing opening therein;

a first cylindrical roller and a second cylindrical roller, each having an axis that is substantially fixedly mounted within the housing, wherein the surfaces of the rollers coact with each other and the tape surfaces therebetween to retain, guide and feed the tape through the tape dispensing opening to the exterior application surface;

wherein the outer surface of the first roller protrudes through the application surface on one side of the opening enabling frictional contact of the roller surface with the substrate surface, the roller surface being in frictional contact with the second surface of the tape;

wherein the outer surface of the second roller is in contact with the first surface of the tape with the adhesive thereon;

a substantially fixed guide means positioned between the rollers for assisting in retaining and guiding the tape through the rollers and tape dispensing opening to the exterior application surface, a cutting blade fixedly mounted within the tape dispensing opening;

whereby when the application surface of the tape dispenser passes over the substrate surface in one direction the outer surface of the first roller engages the substrate surface and the second surface of the tape causing the roller to roll along the substrate surface and to coact with the tape and drive the second roller to thereby feed the tape through the opening, the guide means assisting in retaining and guiding the tape through the rollers and tape dispensing opening to the exterior application surface, enabling the first surface of the tape with the pressure sensitive adhesive thereon to contact the substrate surface and adhere thereto by pressure from the first roller, and when the dispenser is moved in a direction different than the one direction, the tape is cut by the blade and the tape end remains within the housing and near the opening.

2. The tape dispenser of claim 1, wherein the second roller has a reduced diameter over a substantial portion of its length that is not in contact with the first surface of the tape.

3. The tape dispenser of claim 2, further comprising a plurality of ratchets on the reduced diameter of the second roller and at least one ratchet stop projecting from the guide means engaging the ratchet to prevent the second roller from moving in a specified direction.

4. The tape dispenser of claim 2, further comprising a plurality of fingers projecting from the guide means over the reduced diameter of the second roller to guide the tape through the rollers.

5. The tape dispenser of claim 1, wherein the second surface of the tape has a pressure sensitive adhesive thereon and each of the first and second rollers have a reduced diameter over a substantial portion its length that is not in contact with the first or second surfaces of the tape.

6. The tape dispenser of claim 1, wherein the cutting blade is fixedly mounted to the guide means.

7. The tape dispenser of claim 1, wherein the cutting blade has a cutting edge and is fixedly mounted to the guide means, the cutting edge facing into the housing, whereby when the dispenser is moved in a direction different than the one direction, the tape is cut by the blade.

8. A handheld tape dispenser for applying tape to a substrate surface, the tape having a first surface with a pressure sensitive adhesive thereon and a second surface, the dispenser comprising:

a housing suitable for holding and dispensing a roll of tape, the housing including an exterior application surface having a tape dispensing opening therein;

a first cylindrical roller and a second cylindrical roller, each having an axis that is substantially fixedly mounted within the housing, the second roller having a reduced diameter over a substantial portion of its length, wherein the surfaces of the rollers coact with each other and the tape surfaces therebetween to retain, guide and feed the tape through the tape dispensing opening to the exterior application surface;

wherein the outer surface of the first roller protrudes through the application surface on one side of the opening enabling frictional contact of the roller surface with the substrate surface, the roller surface being in contact with the second surface of the tape;

wherein the outer surface of the second roller is in contact with the first surface of the tape with the adhesive thereon, the reduced diameter not being in contact with the first surface of the tape;

a substantially fixed guide means positioned between the rollers for assisting in retaining and guiding the tape through the rollers and tape dispensing opening to the exterior application surface;

a cutting blade fixedly mounted to the guide means within the tape dispensing opening;

whereby when the application surface of the tape dispenser passes over the substrate surface in one direction the outer surface of the first roller engages the substrate surface and the second surface of the tape causing the roller to roll along the substrate surface and to coact with the tape and drive the second roller to thereby feed the tape through the opening, the guide means assisting in retaining and guiding the tape through the rollers and tape dispensing opening to the exterior application surface, enabling the first surface of the tape with the pressure sensitive adhesive thereon to contact the substrate surface and adhere thereto by pressure from the first roller, and when the dispenser is moved in a direction different than the one direction, the tape is cut by the blade and the tape end remains within the housing and near the opening.

9. A handheld tape dispenser for applying tape to a substrate surface, the tape having a first surface with a pressure sensitive adhesive thereon and a second surface, the dispenser comprising:

a housing suitable for holding and dispensing a roll of tape, the housing having a tape dispensing opening therein;

a first cylindrical roller and a second cylindrical roller, each having an axis that is substantially fixedly mounted within the housing, wherein the surfaces of the rollers coact with each other and the tape surfaces therebetween to retain, guide and feed the tape through the tape dispensing opening;

wherein the outer surface of the first roller protrudes through the opening enabling frictional contact of the roller surface with the substrate surface, the roller surface being in frictional contact with the second surface of the tape;

wherein the outer surface of the second roller is in contact with the first surface of the tape with the adhesive thereon;

a substantially fixed guide means positioned between the rollers for assisting in retaining and guiding the tape through the rollers and tape dispensing opening, a cutting blade fixedly mounted in the tape dispensing opening;

whereby when the tape dispenser passes over the substrate surface in one direction the outer surface of the first roller engages the substrate surface and the second surface of the tape causing the roller to roll along the substrate surface and to coact with the tape and drive the second roller to thereby feed the tape through the opening, the guide means assisting in retaining and guiding the tape through the rollers and tape dispensing opening, enabling the first surface of the tape with the pressure sensitive adhesive thereon to contact the substrate surface and adhere thereto by pressure from the first roller and when the dispenser is moved in a direction different than the one direction, the tape is cut by the blade and the tape end remains within the housing and near the opening.

10. The tape dispenser of claim 9, wherein the second roller has a reduced diameter over a substantial portion of its length that is not in contact with the first surface of the tape.

11. The tape dispenser of claim 10, further comprising a plurality of ratchets on the reduced diameter of the second roller and at least one ratchet stop projecting from the guide means engaging the ratchet to prevent the second roller from moving in a specified direction.

12. The tape dispenser of claim 10, further comprising a plurality of fingers projecting from the guide means over the reduced diameter of the second roller to guide the tape through the rollers.

13. The tape dispenser of claim 9, wherein the second surface of the tape has a pressure sensitive adhesive thereon and each of the first and second rollers have a reduced diameter over a substantial portion its length that is not in contact with the first or second surfaces of the tape.

14. The tape dispenser of claim 9, wherein the cutting blade is fixedly mounted to the guide means.

15. The tape dispenser of claim 9, wherein the cutting blade has a cutting edge and is fixedly mounted to the guide means, the cutting edge facing into the housing, whereby when the dispenser is moved in a direction different than the one direction, the tape is cut by the blade.

* * * * *